US005664684A

United States Patent [19]

Evert

[11] Patent Number: 5,664,684

[45] Date of Patent: Sep. 9, 1997

[54] SHRINK WRAPPED PACKAGE AND METHOD FOR ITS PRODUCTION

[75] Inventor: Daniel Don Evert, Vernon Hills, Ill.

[73] Assignee: H.J. Heinz Company, Pittsburgh, Pa.

[21] Appl. No.: 521,216

[22] Filed: Aug. 30, 1995

Related U.S. Application Data

[62] Division of Ser. No. 220,238, Mar. 30, 1994, Pat. No. 5,472,092.

[51] Int. Cl.[6] ..... B65D 25/00

[52] U.S. Cl. ..... 206/769; 206/526; 229/103.2; 229/103.3

[58] Field of Search ..... 206/424, 432, 206/769, 427, 497, 526; 229/103.3, 162, 103.2

[56] References Cited

U.S. PATENT DOCUMENTS

| | | | |
|---|---|---|---|
| 1,705,849 | 3/1929 | Barber | 229/162 |
| 1,898,208 | 2/1933 | Olsen, Jr. et al. | 229/162 |
| 2,283,046 | 5/1942 | Clouston | 229/162 |
| 3,006,524 | 10/1961 | Todd | 229/16 |
| 3,185,371 | 5/1965 | Reifers | 229/2.5 |
| 3,670,880 | 6/1972 | Burleson et al. | 206/386 |
| 3,713,450 | 1/1973 | Williamson | 229/162 |
| 3,945,493 | 3/1976 | Cardinal | 206/432 |
| 4,094,406 | 6/1978 | Zietzschmann | 206/497 |
| 4,319,680 | 3/1982 | Hiemstra | 206/434 |
| 4,397,391 | 8/1983 | Cornelissens et al. | 206/526 |
| 4,403,695 | 9/1983 | Raymoure et al. | 206/497 |
| 4,405,078 | 9/1983 | Dutcher et al. | 206/434 |
| 4,895,296 | 1/1990 | Trauschke | 229/40 |
| 4,911,300 | 3/1990 | Colonna | 206/427 |
| 4,919,270 | 4/1990 | Govang et al. | 206/597 |
| 5,197,625 | 3/1993 | Mullaney | 229/162 |
| 5,230,914 | 7/1993 | Akervik | 426/107 |

*Primary Examiner*—David T. Fidei

*Attorney, Agent, or Firm*—Fitch, Even, Tabin & Flannery

[57] ABSTRACT

A shrink wrapped package which provides improved aesthetics in the shrink wrapping of a stack of articles. A stack of articles are received within a sleeve which surrounds the stack of articles and maintains them in stacked relation. One of the end articles in the stack has sidewalls which are spaced from the sleeve. The end of the sleeve adjacent the end article has pivotable panels dependent therefrom, which are moveable from a position spaced from the sidewall of the end article into abutment with the sidewall of the end article. The articles are received in the sleeve with the panels spaced form the article sidewall, and the sleeve is then wrapped in a sheet of shrinkable material. Upon shrinkage of the shrinkable material, the material pulls the flaps into contact with the article sidewall, and the shrinkable material conforms smoothly to the contour of the sleeve without inward bending or warping of the sleeve.

5 Claims, 4 Drawing Sheets

SHRINK WRAPPED PACKAGE AND METHOD FOR ITS PRODUCTION

This is a division of application Ser. No. 08/220,238, filed Mar. 30, 1994, now U.S. Pat. No. 5,472,092.

FIELD OF THE INVENTION

The present invention pertains to shrink wrapped packaging, and more particularly to providing improved aesthetics in shrink wrapped packaging of a plurality of stacked articles.

BACKGROUND OF THE INVENTION

Shrink wrapping is well known as an efficient and low cost manner of encasing articles in a plastic overwrap. Shrink wrap material typically comprises a thin plastic extruded film which is placed under tension and stretched while still hot, and maintained under tension while cooled to ambient temperature. While maintained at ambient temperature, the film retains its stretched dimensions. When heat is re-applied to the film, it returns to original size. To encase articles in a plastic overwrap, the articles are wrapped in plastic shrink wrap material and passed through a heat tunnel, whereupon the shrink wrap material shrinks and pulls tightly about the articles. Upon subsequent cooling to ambient temperature again, the shrink wrap material retains its shrunken-dimensions and remains lightly wrapped about the articles. Thus, the shrink wrap material holds the articles together and provides protection of the articles from weather and the like during shipping.

Shrink wrapping material generally conforms smoothly about the exterior surfaces of the wrapped articles. However, it has been found that the shrink wrap material wrinkles over exterior surface portions of the articles having spaces or gaps. Such wrinkling of the shrink wrap material which occurs over gaps or spaces of the articles is generally acceptable for shipping purposes, wherein the aesthetics of the wrapped articles are not particularly important. However, in consumer products it is important that the product package have a good aesthetic appearance. Hence, there is a need for a shrink wrapped package for use in packaging consumer products in which the shrink wrap material extends substantially unwrinkled over the packaged articles, including spaces or gaps in the articles.

More particularly, in the shrink wrapping of a stack of containers, such as microwavable food containers, wherein each of the containers has inwardly sloped sides and a cover which extends outwardly beyond the sloped sides of the respective container, the shrink wrap material tends to wrinkle considerably in the space below the outwardly extending cover of the bottom container. That is, the outward extension of each cover, and the inwardly sloped walls of each of the containers beneath their respective covers, forms a space or gap between the container walls and the peripheries of the covers, over which space the shrink wrap material extends without support. The lack of support for the shrink wrap material over these spaces causes the shrink wrap material to wrinkle in the space. Accordingly, there is a need for a shrink wrapped package having a plurality of stacked containers, each with sloped sides and enlarged cover, which does not have significant wrinkling.

A paperboard sleeve has been used to surround the stack of containers and thereby provide support for the shrink wrap material about the periphery of the stack of containers sufficient to reduce wrinkling. However, at the lower end of the sleeve, where the sidewalls of the lowermost container of the stack slopes inwardly beneath the overhanging cover, the sleeve end is spaced from the sidewall of the lowermost container and there is no support for the sleeve. Hence, upon shrinkage of shrink wrap material about the sleeve, the inward force exerted by the shrink wrap material warps or bends the lower end of the sleeve inwardly, resulting in an aesthetically inferior product. Accordingly, there is a need for packaging suitable for encasing a stack of containers in shrinkable material which provides a shrink wrapped package having good aesthetic appearance, without significant warpage or wrinkling.

Still further, the shrink wrap material is frequently torn or punctured by the sharp corners of the stack of articles and there is a need for a shrink wrapped package which substantially reduces puncturing or tearing of the corners of the package.

SUMMARY OF THE INVENTION

In accordance with the present invention, a plurality of articles having inwardly sloped sides and a cover which extends outwardly beyond the sloped sides of the respective container are maintained in stacked relation by a hollow sleeve which encircles the stacked articles. The sleeve extends vertically from the top article to the bottom article to provide a supporting surface for the shrink wrap material about the periphery of the stack of articles to prevent wrinkling thereof.

To overcome the problem of wrinkling of the shrink wrap film and the problem of inward bending or warpage of the lower end of the sleeve into the space between the sleeve and the sloped sidewalls of the bottom container under the influence of the inward force exerted by the shrink wrap material as it shrinks., the sleeve is provided with flaps pivotably attached to the lower end of the vertically extending sleeve. The lower, free ends of the flaps are pivotal from a vertical position spaced from the sidewalls of the bottom container, to a position in contact with the sidewalls of the bottom container. The inwardly pivoted flaps serve to bridge the space between the sloped sides of the lowermost article and the sleeve, into which space, the shrink wrap film may otherwise move and become wrinkled. The flaps provide a supporting surface for the shrink wrap film to allow the film to extend smoothly over the flaps.

Inward bending and curving of the lower end of the sleeve under the influence of the inward force exerted by the shrink wrap film is also prevented by the provision of the flaps. When pivoted inwardly, the upper, pivotal ends of the flaps reside at the perimeter of the cover of the bottom container, and the lower ends of the flaps reside at the bottom of the sloped sidewalls of the bottom container. Hence, in their inwardly pivoted positions the flaps are supported by the bottom container which provides support to the flaps to prevent their inward bending or curving when the shrink wrap material is shrunk about the sleeve. Thereby, the provision of the pivotable flaps at the lower end of the sleeve also prevent inward bending or warping of the sleeve at the lower end of the shrink wrapped package.

To form the sleeve, an elongated sheet of material is cut and scored and its ends glued together. The stack of articles are loaded into the hollow interior of the sleeve with the flaps extending generally vertically downwardly. Then shrink wrap material is wrapped about the sleeve and the stacked articles therein. Subsequent exposure to heat acts to shrink the shrink wrap material about the sleeve. The inward force exerted by the shrink wrap material, as it shrinks about the sleeve, urges the panels inwardly to pivot them into abutment with the sidewall of the bottom container.

The upper and lower ends of each of the panels of the sleeve are tapered and rounded to reduce tearing or puncturing of the shrink wrap at the corners of the stack of articles.

BRIEF DESCRIPTION OF THE DRAWINGS

In the drawings, wherein like elements are referenced alike.

DETAILED DESCRIPTION OF THE PREFERRED EMBODIMENTS

Figure 1:
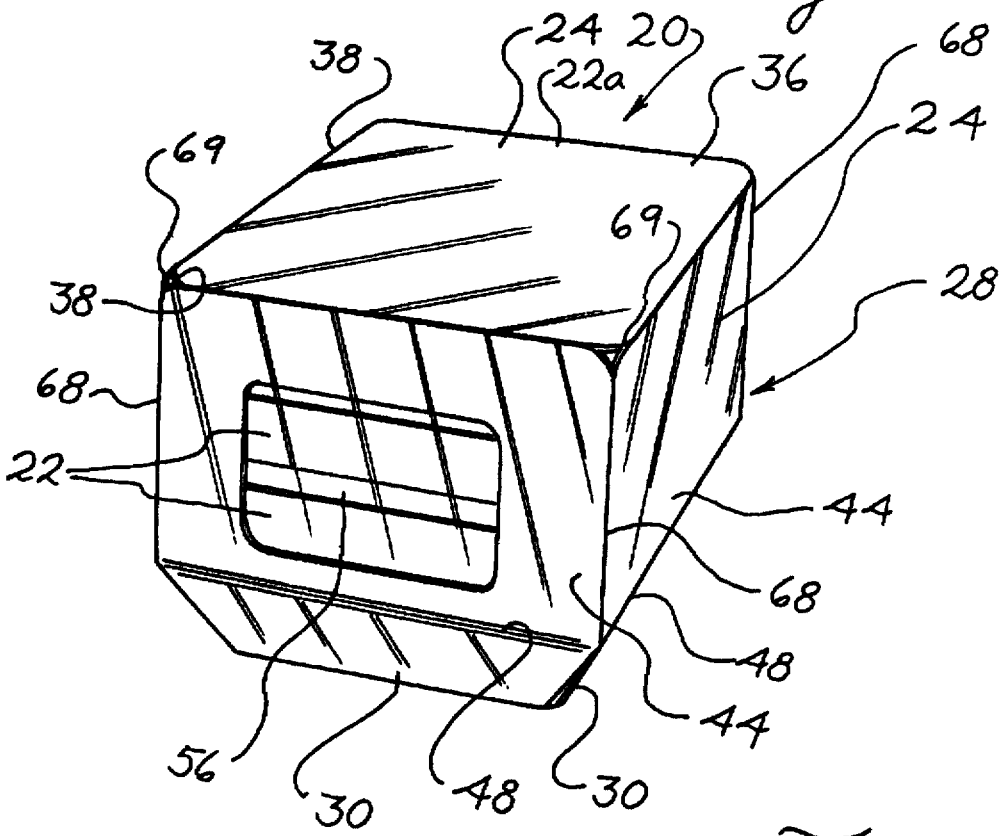
FIG. 1 is a perspective view of a shrink wrapped package embodying various features of the present invention.

A shrink wrapped package embodying various features of the present invention is illustrated in FIG. 1, and referred to generally by reference numeral 20. The package 20 contains a plurality of stacked articles, which are containers 22 in the illustrated embodiment, though, manifestly, the invention is not limited in this regard and lends itself to use with any number of stacked articles, and articles of a wide variety of different shapes. A sleeve 28 encircles the stack of containers 22, and the sleeve 28 and the stack of articles 22 therein are encased in shrink wrap film 24.

The sleeve 28 has pivotable flaps 30 at its lower end 32 which are pivoted inwardly from a position spaced from the walls 40 of the bottom article **22*b* in the stack, into contact with the bottom edge of walls 40 of the bottom article 22*b* in the stack under the influence of the shrink wrap film. The flaps 30 bridge the space between the walls 40 of the bottom article 22*b* and the cover 36 to provide supporting surfaces for the shrink wrap film 24 to reduce wrinkling of the film at the lower end of the package 20. Also, when pivoted inwardly, the flaps 30 at the lower end 32 of the sleeve 28 are supported by the bottom edge of article 22*b* so that the lower end 32 of the sleeve 28 does not bend or curve inwardly under the influence of the shrink wrap film 24 as it shrinks about the sleeve 28**. Thereby, a neat appearing shrink wrapped package is produced with less wrinkling and straighter edges.

Figure 2:
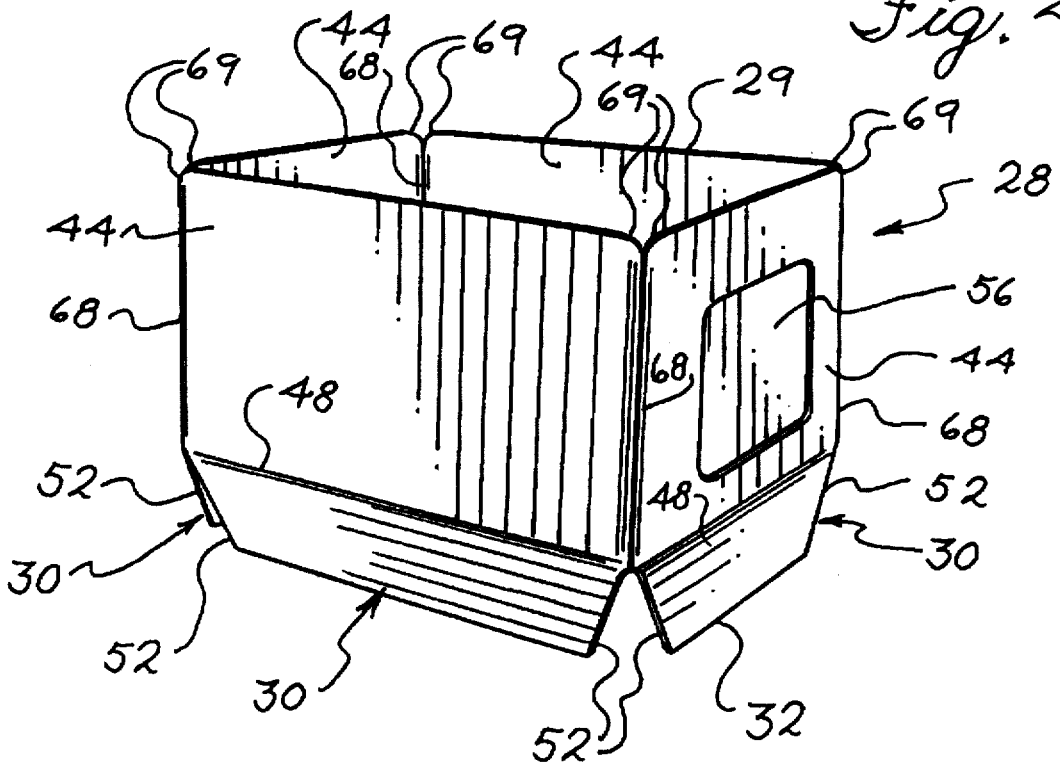
FIG. 2 is a perspective view of the sleeve of the shrink wrapped package of FIG. 1.
Figure 3:
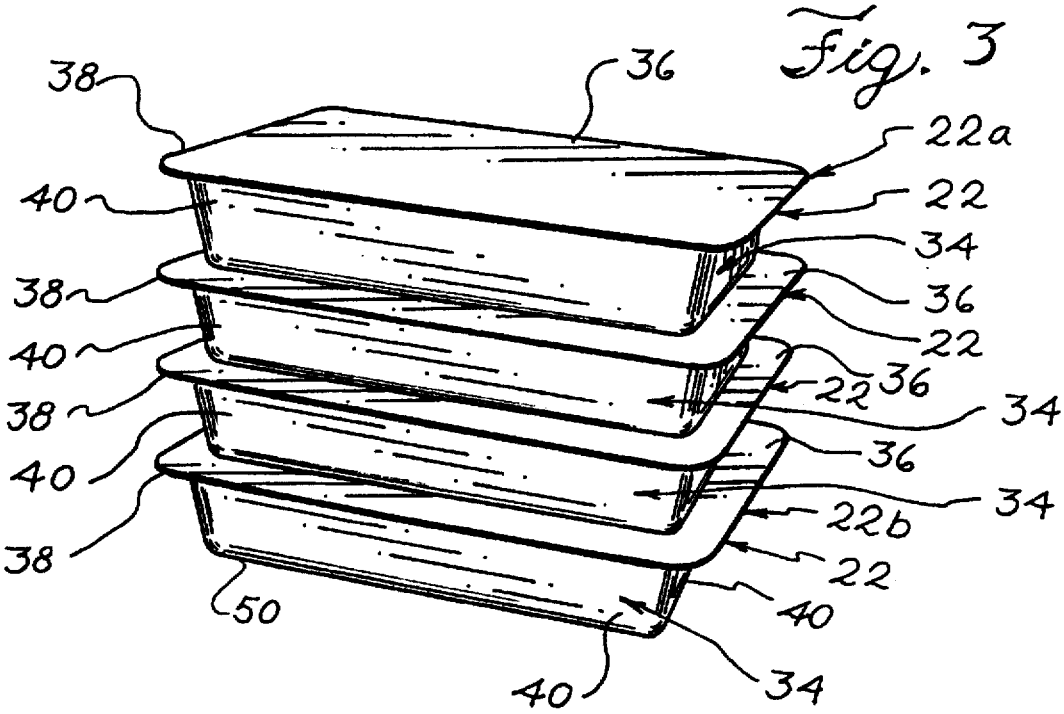
FIG. 3 is a perspective view of the stack of articles of the shrink wrapped package of FIG. 1.

With reference now to the preferred embodiment of the present invention, the package 20 of the present invention has a plurality of containers, referred to generally by numeral 22, arranged in a stack having top end and bottom end articles 22a and **22*b*, respectively, as shown in FIG. 3. Four stacked containers 22 are shown to illustrate the invention. A hollow sleeve 28, illustrated separately in FIG. 2, encircles the stack of articles 22 and maintains the articles 22 in stacked relation. The sleeve 28 has an upper end 29 and a lower end 32 which are, respectively, positioned adjacent the top end article 22*a* and bottom end article 22*b* of the stack of articles 22**.

With reference to FIG. 3, each of the illustrated articles 22 has a lower rectangular compartment portion 34 defined by walls 40 in which food or other items are stored, and an upper cover portion 36 for enclosing the items in the lower compartment portion 34. As best seen in the sectional views of FIGS. 6 and 7, the ends 38 of the upper cover portions 36 extend outwardly beyond the walls 40 of the respective compartment portions 34, with the walls 40 sloping downwardly and inwardly at an angle of approximately ten degrees from vertical.

The sleeve 28 has a plurality of integral, mutually perpendicular panels 44 which define a rectangular interior. The panels 44 are proportioned in relation to the peripheries of the cover portions 36 so that, upon receipt of the stack of articles in the rectangular interior of the sleeve 28, each of the panels 44 of the sleeve 28 lie directly adjacent respective ends 38 of the cover portions 36 of the articles 22, to maintain the articles 22 in centered, stacked relation. Since the cover portions 36 of the articles 22 extend outwardly beyond the walls 40 of their respective compartment portions 34, and the walls 40 slope downwardly and inwardly, the walls 40 of each of the articles 22 are separated by a space from the panels 44 of the sleeve 28.

Figure 9:
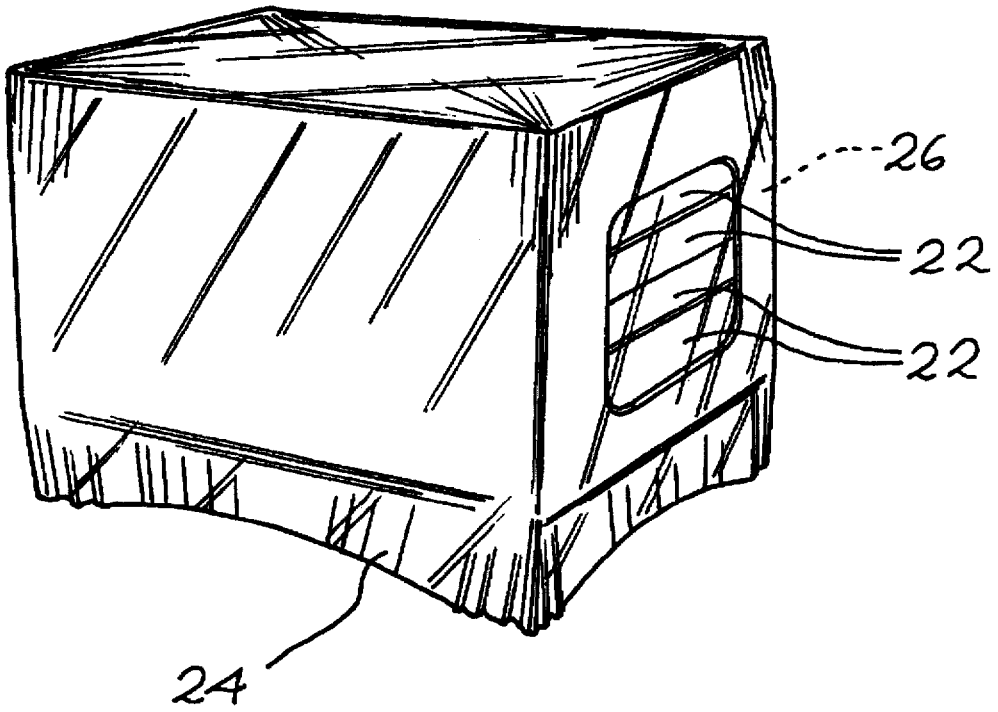
Fig. 9 (PRIOR ART)
FIG. 9 is a perspective view of the stack of containers of FIG. 3 received in a sleeve not having pivotable panels at its lower end, to illustrate the inward warping of the lower end of the sleeve which is realized in the absence of the flaps.

Upon shrinking of shrink wrap material 24 about the sleeve 28 with the stacked articles therein, the shrink wrap material 24 exerts an inward force on the sleeve panels. Since, as discussed above, the sleeve panels 44 surrounding the articles 22 reside directly adjacent respective ends 38 of the cover portions 36 of the articles 22, the ends 38 of the cover portions provide support to the sleeve panels 44 to prevent significant inward movement of the sleeve panels 44 upon shrinkage of the shrinkable material. However, in the region below the cover portion 36 of the bottom container **22*b*, there is no support to prevent inward movement of the sleeve panels 44. Absent the provision of flaps 30 at the lower end 32 of the sleeve 28, as taught by the present invention, the shrink wrap material 24 pulls and bends the central portions of the lower end 32** of the sleeve panels inwardly, so that the lower ends of the sleeve panels are warped or curved, as illustrated in FIG. 9, which is undesirable due to the poor aesthetic appearance which is created.

In order to provide improved aesthetics, flaps 30 are provided which are pivotably attached at the lower ends of respective panels 44, with the flaps 30 being positioned at a height below the cover 36 of the bottom container **22*b*. That is, hinge lines 48 extend horizontally across the sleeve 28 near its lower end 32 to define the flaps 30 adjacent the lower end 32 of the sleeve. The hinge lines 48 separate each respective side of the sleeve 28 into a flat vertical panel 44 with a flap 30 pivotally dependent therefrom. The hinge lines 48 thus serve as hinges along which each of the flaps 30 are pivotably attached to respective panels 44**.

The hinge lines 48 are formed at a predetermined distance from the end 32 of the sleeve 28, which distance corresponds to the distance between the cover 36 and the bottom 50 of the bottom container **22*b*, so that the hinge lines 48 reside directly adjacent the sleeve ends 38**.

Figure 6:
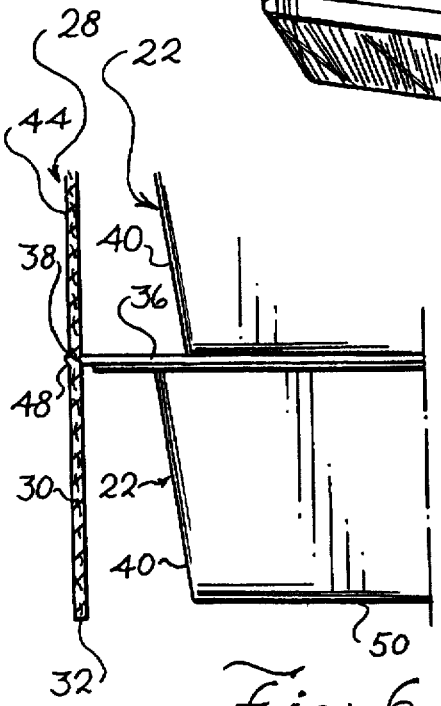
FIG. 6 is an enlarged fragmentary, elevational view of the lower end of the package of FIG. 4 with no shrink wrap material, illustrating the flap spaced from the article wall.
Figure 7:
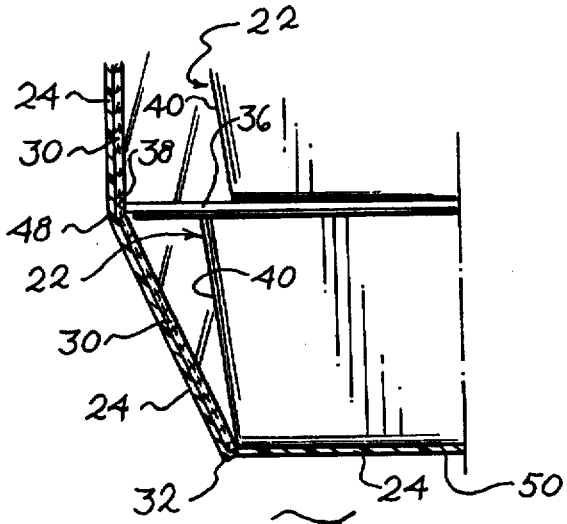
FIG. 7 is an enlarged fragmentary, elevational view of the lower end of the package of FIG. 1 having shrink wrap material, illustrating the flap moved into contact with the article wall.

With brief reference to FIGS. 6 and 7, the flaps 30 are pivotable from the generally vertical position of FIG. 6, whereat they are spaced from the walls 40 of the bottom container 26b, into abutment with the walls 40 of the bottom container 22b, as illustrated in FIG. 7 during shrink wrapping. With the flaps 30 moved into abutment with respective walls 44 of the bottom container 22b, the walls 44 of the bottom container 22b provide support for the flaps 30 to substantially prevent inward bending or warping of the lower end 32 of the sleeve 28. This produces the shrink wrapped package 20 with sharp, crisp edges illustrated in FIG. 1, and described in detail below.

Figure 4:
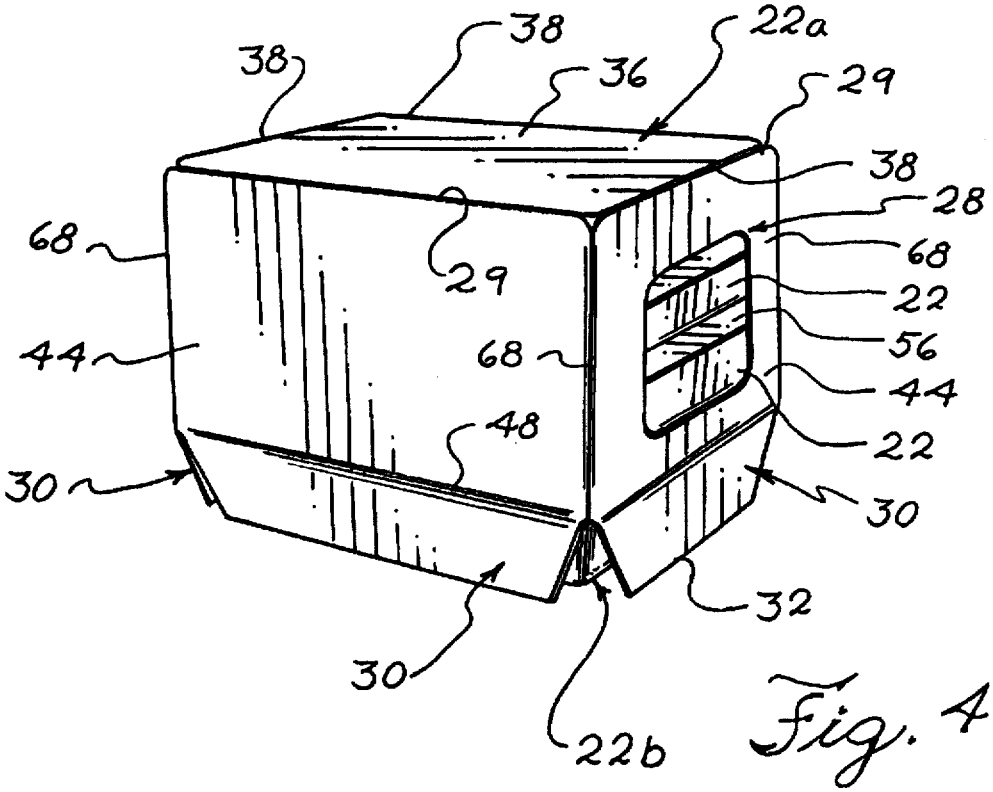
FIG. 4 is a perspective view of the shrink warp package of FIG. 1 without the outer layer of shrink wrap material.

To form the shrink wrapped package 20, the stack of containers 22 (see FIG. 3) are inserted into the sleeve 28 (see FIG. 2) with the flaps 30 extending generally vertically downwardly from their respective sleeve panels 44, as illustrated in perspective in FIG. 4 and in cross section in FIG. 6. With the containers 22 inserted into the sleeve 28, the hinge lines 48 between each of the panels 44 and respective depending flaps 30 resides directly adjacent the ends 38 of the cover portion 36 of the bottom container 22b. Also, as best seen in FIG. 4, the ends 38 of the cover 36 of the uppermost container 22a reside adjacent the upper end 29 of the sleeve 28.

The sleeve 28, and the stack of containers 22 therein, are then enclosed loosely in shrink wrap film 24. The preferred method for encasing in shrink wrap film is described further below. Subsequently, the shrink wrap film 24 is activated, such as by exposure to heat, to shrink the film 24 about both the sleeve 28 and stack of articles 22 therein to produce the shrink wrapped package 20 illustrated in FIG. 1.

As the film 24 shrinks, it is drawn inwardly about the sleeve 28 and the film 24 conforms to the contour of the sleeve 28. The inward force exerted by the shrink wrap film 24 pivots the panels 30 from their initial vertical position, spaced from the walls 40 of the bottom article 22b (see FIG. 6), to an angled position, in which the lower ends 32 of the flaps 30 are in contact with the walls 40 of the bottom article 22b (see FIG. 7). Hence, at their angled positions, each of the flaps 30 are supported along their entire width to prevent inward bending under the influence of the film 24. Specifically, the upper ends of the flaps 30, as defined by the hinge lines 48, are supported from inward bending by the ends 38 of the cover 36 of the bottom container 22b. The lower ends 32 of the flaps 30 are supported from inward bending by the wall 40 of the bottom container 22b.

Accordingly, the provision of the flaps 30 at the lower end 32 of the sleeve 28 provides the shrink wrapped package 20 of the present invention with straight edges at its lower end, rather than the curved edges which result at the lower end of shrink wrapped packages of the prior art which do not have flaps (see FIG. 9).

The present invention lends itself to use with any shrink wrap material and shrink wrapping method, however the preferred shrink wrap method consists of sealing two overlapping sheets of film together over three sides to form a pouch of shrink wrap film which is sealed about three sides and has an open side. The sleeve 28, with the stack of containers 22 therein, is placed into the open end of the pouch, and then the open end of the pouch is sealed and the film heated to shrink the pouch. The pouch is preferably formed by folding over a length of shrink wrap film, and sealing the upper and lower sheets to one another along narrow strips extending across the width of the film to define a pouch having a rear side defined by the fold in the film, a pair of lateral sides defined by the aforementioned sealing together of the upper and lower sheets of film at spaced intervals, and an open front side. The length of film is then cut at the two lateral side seals to separate the formed pouch from the length of film and the articles stacked within a sleeve are inserted into the open end of the formed pouch. The open, front end of the pouch is sealed and the pouch is heated to shrink the film. The film encases the sleeve 28 and stacked articles 22 therein, with sealing lines of the film extending about three of the four panels 44 of the sleeve.

At the point of purchase, the shrink wrapped package 20 is oriented on the store shelf with the cover portion 36 of the uppermost container 22a facing forward, whereupon the sealed front end of the film faces downwardly and the lateral side seals are positioned on the left and right sides of the package 20. The shrink wrap film extends smoothly, and without seams, over the forwardly facing cover portion 36 and upwardly facing panel 44 to present a good appearance to the consumer.

To prevent abutment of the sides 52 of adjacent flaps 30, which may result in bending or crushing of the adjacent flaps upon their being, drawn inwardly by the shrink wrap film 24, the sides 52 of the flaps 30 are tapered. The extent of tapering of the sides 52 of the flaps 30 is dependent upon the amount of inward movement which the flaps 30 must undergo in being moved into contact with the bottom container 22b. The flap sides 52 are tapered sufficiently that the sides 52 of adjacent flaps 30 lie closely adjacent one another but do not overlap when the adjacent flaps 30 are moved to their inwardly pivoted positions in contact with the walls 40 of the bottom container 22b.

The upper corners 69 of each of the sleeve panels 44 are rounded, as best seen in FIG. 2, both to prevent crushing of the upper corners of the sleeve 28 upon shrinking of the overwrapping shrink wrap film 24, and to reduce puncturing of the shrink wrap film 24 at the upper corners of the completed shrink wrapped package 20 during shipping and handling.

A pair of opposite panels 44 have respective apertures 56 formed in a central portion thereof. The apertures allow viewing of the stack of articles 22 disposed within the sleeve 28. In particular, the apertures 56 allow viewing of the containers 22 disposed between the uppermost container 22a and the lowermost container 22b, which articles 22 would otherwise have no visibility in the final, assembled shrink wrapped package 20. The cover 36 of the uppermost container 22a and the bottom 50 of the bottom container 22b are respectively visible through the top and bottom of the sleeve 28 without the apertures 56. In this regard, in the preferred embodiment, identifying indicia is provided on the top cover so that the design is readily visible and facing forward when the shrink wrapped package 20 is oriented on the store shelf in the manner discussed above.

Figure 8:
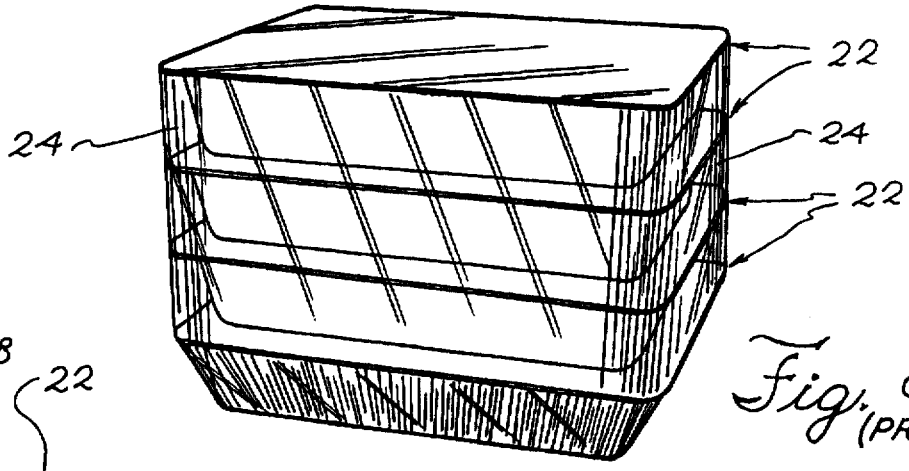
Fig. 8 (PRIOR ART)
FIG. 8 is a perspective view of the stack of containers of FIG. 3 wrapped directly in shrink wrap material without a sleeve, illustrating the wrinkling of the shrink wrap material, particularly in the region adjacent the lower end of the stack.

To illustrate some of the positive attributes of the shrink wrapped package 20 of the present invention, some prior art shrink wrapped packages for a stack of articles are illustrated. A shrink wrapped package of the prior art is illustrated in FIG. 8, wherein a plurality of articles 22 stacked one upon another are directly encased in shrink wrap material 24. As seen in FIG. 8, at the sides and lower end of this shrink wrapped package of the prior art, the shrink wrap material 24 is significantly wrinkled. This unsightly wrinkling is attributable to the extensive spaces and gaps over which the shrink wrap material extends without adequate support. Contrarily, as illustrated in FIG. 1, the provision of a sleeve encircling the stack of articles 22 provides a supporting surface for the shrink wrap material 24 and substantially eliminates the wrinkling about the periphery of the stack of articles.

However, while a conventional prior art sleeve 26, such as that illustrated in FIG. 9, is suitable for preventing wrinkling of shrink wrap material 24 about the periphery of the stack of articles, it has the shortcoming of bending or warping inwardly at the lower end of the sleeve. That is, the lower ends of the panels of the conventional sleeve bend or warp inwardly under the influence of the inward force exerted by the shrinkable material 24, as illustrated in FIG. 9. More specifically, at the lower end of the stack of containers 22, the bottom container steps down in size from its cover to the bottom of the container so that there is a space between the lower end of the sleeve and the sidewalls of the bottom container 22. Hence, when the shrink wrap material is shrunk about the sleeve, the middle portion of the lower ends of the sleeve panels are pulled in and curve inwardly into the aforementioned space between the sleeve and the walls of the bottom container 22 due to the lack of adequate support thereat, as illustrated in FIG. 9.

This inward bending or warping of the sleeve is undesirable in that it presents a poor aesthetic appearance. As discussed above, the problem of inward bending or warping of the lower end of the sleeve during shrink wrapping is overcome by the provision of flaps 30 at the lower end 32 of the sleeve 28 of the shrink wrap package 20 of the present invention.

Figure 5:
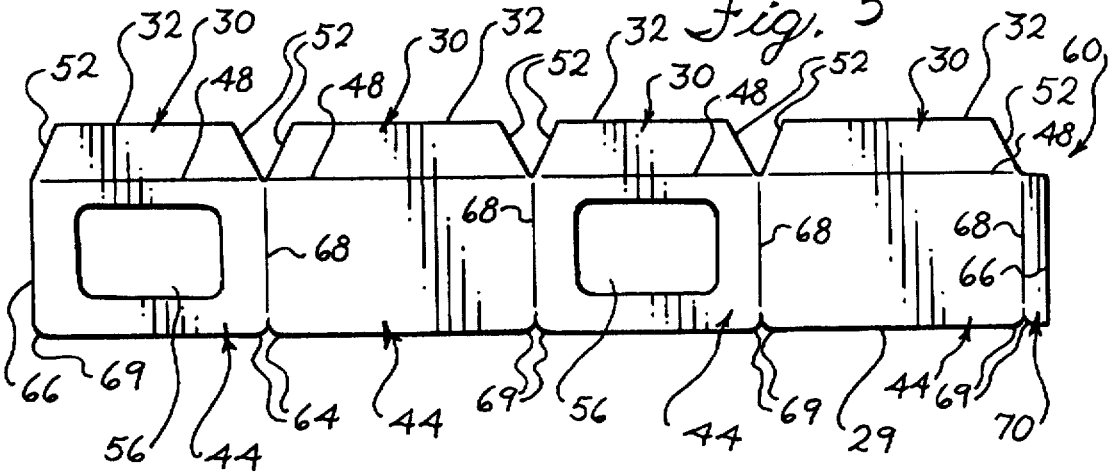
FIG. 5 is a plan view of a blank for forming the sleeve of FIG. 2.

The sleeve 28 is preferably formed from a paperboard blank 60 such as that illustrated in FIG. 5 which is folded and glued to form the sleeve 28 of FIG. 2. With continued reference to FIG. 5, the blank 60 is formed from an elongated sheet of material and has an upper end 62, a lower end 64, and opposite side ends 66. A plurality of vertical fold lines 68, which may be score lines or other suitable lines of weakness, are formed in the blank 60 extending from its upper end 62 to its lower end 64 to divide the sheet into a plurality of panels 44 intermediate of the pair of side ends 66, and to define a short end panel 70 adjacent one of the ends 66. A horizontal hinge line 48, which also may be a score line or other line of weakness, extends across the length of the blank 60 from one end 66 to the other end 66. The hinge line 48 extends generally parallel to, and spaced a predetermined distance from, the lower end 64 of the blank 60. The horizontal hinge line 48 defines the flaps 30 over the portion of the sleeve 28 between the horizontal hinge line 48 and the lower end 64, and provides pivotability of the flaps 30 at the lower end of respective panels 44. The sides 52 of the flaps 30 are tapered inwardly toward the lower end 64 of the blank, for the reasons stated above. The flap portion at the lower end of the short end panel 70 is removed to leave four integral panels 44 having respective tapered flaps 30 pivotally dependent from the lower ends of respective panels 44 along hinge lines 48, and a short end panel 70 without a flap dependent therefrom. The panels 44 and 70 are foldable with respect to one another along vertical fold lines 68. Apertures 56 are stamp cut into the central portion of two spaced-apart panels. The corners 69 where the vertical fold lines 68 meet the upper end 62 of the blank 60 are rounded and the corner 69 at the upper end 62 of the blank 60 opposite the shirt panel 70 is rounded, so that the corners 69 of the upper ends 29 of each of the sleeve panels 44 are rounded upon formation of the shrink wrapped package 20.

To form the sleeve 28 of FIG. 2, the blank 60 is folded along each of the vertical fold lines 68 to form the rectangular configuration of FIG. 2. The short flap 70 overlaps, and resides inwardly of, the end portion of the panel 44 opposite the short flap 70. Adhesion between the overlapping short flap 70 and the end portion of the opposite panel 44, such as by gluing them together, is all that is required to form the sleeve 28 of FIG. 2. The hinge lines 48 between the panels 44 and their respective flaps 30 allow the flaps 30 to pivot inwardly along the hinge lines 48 under the influence of the shrink wrap film 24 as it shrinks, as discussed above.

What is claimed is:

1. A blank for forming a sleeve for encircling a stack of articles to hold the articles in the stack and for reducing formation of wrinkles in the shrink-wrapping of the stacked articles, the blank comprising:

an elongated sheet of material having an upper end and a lower end and a pair of side ends:

a plurality of vertical score lines in said elongated sheet extending from said upper end to said lower end to define a plurality of panels separated by vertical score lines intermediate of the pair of side ends;

one and only one horizontal score line extending parallel to said lower end and spaced a predetermined distance from said lower end to define a pivotable portion adjacent the lower end of the sheet;

a plurality of slits extending from said lower end to said horizontal score line to divide said pivotable portion into a plurality of separate flaps, each pivotably connected to the lower end of a respective panel, said blank having pivotable flaps only at its lower end; and the blank being formable into a rectangular sleeve upon joining together of the panels adjacent said opposite ends, the sleeve so formed having a plurality of panels with pivotable flaps on only one end thereof.

2. A blank in accordance with claim 1 wherein each of said flaps has tapered sides.

3. A blank in accordance with claim 1 wherein at least one of said panels has an aperture.

4. A blank in accordance with claim 1 wherein each of said sleeve panels has rounded upper corners.

5. A blank in accordance with claim 2 wherein the slits extending from the lower end to the horizontal score line to divide the pivotable portion into a plurality of flaps intersect one another at an angle of less than 90°.

* * * * *